US009975338B2

(12) United States Patent
Hatsui et al.

(10) Patent No.: US 9,975,338 B2
(45) Date of Patent: May 22, 2018

(54) METHOD FOR MANUFACTURING LIQUID EJECTION HEAD SUBSTRATE

(71) Applicant: CANON KABUSHIKI KAISHA, Tokyo (JP)

(72) Inventors: Takuya Hatsui, Tokyo (JP); Shuichi Tamatsukuri, Asaka (JP); Souta Takeuchi, Fujisawa (JP); Kenji Takahashi, Yokohama (JP); Soichiro Nagamochi, Oita (JP); Shinya Iwahashi, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days. days.

(21) Appl. No.: 15/217,354

(22) Filed: Jul. 22, 2016

(65) Prior Publication Data

US 2017/0021623 A1 Jan. 26, 2017

(30) Foreign Application Priority Data

Jul. 24, 2015 (JP) ..... 2015-146934

(51) Int. Cl.
*B41J 2/16* (2006.01)
*B41J 2/14* (2006.01)

(52) U.S. Cl.
CPC ..... *B41J 2/1631* (2013.01); *B41J 2/1408* (2013.01); *B41J 2/14024* (2013.01); *B41J 2/14129* (2013.01); *B41J 2/1603* (2013.01); *B41J 2/1626* (2013.01); *B41J 2/1628* (2013.01); *B41J 2/1642* (2013.01); *Y10T 29/49401* (2015.01)

(58) Field of Classification Search
CPC .... B41J 2/14129; B41J 2/1626; B41J 2/1628; B41J 2/1631; B41J 2/1642; B41J 2/14024; B41J 2/1408; B41J 2/1603; Y10T 29/49401
See application file for complete search history.

(56) References Cited

U.S. PATENT DOCUMENTS

2006/0170734 A1* 8/2006 Ibe ..... B41J 2/1628 347/58

FOREIGN PATENT DOCUMENTS

| | | | | |
|---|---|---|---|---|
| JP | H11-10882 A | | 1/1999 | |
| JP | 2006051769 A | * | 2/2006 | ..... B41J 2/14072 |
| JP | 2006-130885 A | | 5/2006 | |

* cited by examiner

*Primary Examiner* — A. Dexter Tugbang
(74) *Attorney, Agent, or Firm* — Canon U.S.A., Inc. IP Division

(57) ABSTRACT

A method for manufacturing a liquid ejection head substrate, in which a heat storage layer, a pair of electrodes extending from the surface of the heat storage layer toward the back surface, a heat-generating resistor layer in contact with the pair of electrodes and the surface of the heat storage layer, and a first cover layer configured to cover the heat-generating resistor layer are stacked, includes the steps of etching the heat-generating resistor layer and the first cover layer by using a mask disposed on a substrate including the heat-generating resistor layer and the first cover layer, removing the mask, and forming a second cover layer configured to cover an end portion of the heat-generating resistor layer in that order.

13 Claims, 7 Drawing Sheets

METHOD FOR MANUFACTURING LIQUID EJECTION HEAD SUBSTRATE

BACKGROUND OF THE INVENTION

Field of the Invention

The present invention relates to a liquid ejection head substrate configured to eject a liquid and a method for manufacturing the same.

Description of the Related Art

A liquid ejection head ejects droplets from an ejection port by heating a liquid rapidly with a heat-generating resistor disposed in a liquid ejection head substrate so as to generate bubbles. The heat-generating resistor is covered by an insulating layer configured to ensure the insulation between the heat-generating resistor and the liquid, a protective layer configured to protect the heat-generating resistor from the impact of cavitation associated with bubble generation or debubbling of the liquid, and the like. It becomes possible to heat the liquid efficiently by making these layers covering the heat-generating resistor thin. Therefore, it is desirable to make these layers thin.

However, in the configuration, in which electrode layers constituting a pair of electrodes configured to supply electric power to the heat-generating resistor are disposed on the front surface or back surface of the heat-generating resistor layer, a large height difference is generated by the pair of electrodes. In general, the electrode is composed of Al, although Al corrodes easily. Therefore, processing is difficult and the shape is not stabilized easily. Regarding the insulating layer or the protective layer disposed on the upstanding portion and the like of the height difference, the film thickness is small and the film quality is degraded compared with a film disposed on a flat portion. Consequently, if the insulating layer or the protective layer is made thin in the above-described configuration, it is difficult to protect the height difference portion generated by the pair of electrodes sufficiently, and shortages of insulation and durability to withstand impact may be caused. Also, the heat-generating resistor may be corroded by a liquid.

Japanese Patent Laid-Open No. 11-10882 proposes a configuration, in which electrodes are embedded in a heat storage layer, the surface thereof is planarized, and a heat-generating resistor layer, an insulating layer, and a protective layer are disposed on the planarized surface, as a form in which a height difference due to an electrode layer is not generated.

Meanwhile, in the case where the heat-generating resistor layer is etched in a production process of a liquid ejection head substrate, a photoresist as an example of a mask is applied to the surface of the substrate provided with the heat-generating resistor layer, and a pattern is formed by using photolithography. At this time, for example, if dry etching is performed by plasma using a gas, e.g., $Cl_2$ or $CF_4$, the surface of the photoresist is altered and the photoresist is not removed completely by only being dipped into an chemical solution configured to dissolve the photoresist.

At the time of bubble generation for ejecting a liquid, the heat-generating resistor reaches a high temperature such as several hundred degrees, and if the photoresist is left on the surface, a breakage may occur at an early stage. Therefore, the photoresist is removed by performing dry ashing using oxygen plasma or the like.

However, if dry ashing is performed such that the photoresist does not remain, the surface of the heat-generating resistor layer is exposed to the oxygen plasma, the surface is oxidized, a portion having a thickness of several nanometers from the surface of the heat-generating resistor layer is altered, and the resistance value of that portion increases. The thickness of the heat-generating resistor is set to be very small in order to increase the resistance value. Therefore, a profound effect is exerted by alteration of even the portion several nanometers from the surface.

The entirety of photoresist is not removed by dry asking at the same timing, the thickness of the portion altered and the degree of the alteration are different depending on the places and, therefore, there are variations in the resistance value. In addition, the durability to withstand current of the heat-generating resistor is degraded because of alteration. Consequently, if there is a portion in which the degree of alteration is great, the heat-generating resistor may break at an early stage.

SUMMARY OF THE INVENTION

Accordingly, the present invention provides a liquid ejection head substrate capable of heating a liquid efficiently and suppressing alteration of the surface of a heat-generating resistor layer during a production process.

The present invention provides a method for manufacturing a liquid ejection head substrate, in which a heat storage layer, a pair of electrodes extending from the surface of the heat storage layer toward the back surface, a heat-generating resistor layer in contact with the pair of electrodes and the surface of the heat storage layer, and a first cover layer configured to cover the heat-generating resistor layer are stacked, the method including the steps of etching the heat-generating resistor layer and the first cover layer of a substrate including the heat-generating resistor layer and the first cover layer by using a mask, removing the mask, and forming a second cover layer configured to cover an end portion of the heat-generating resistor layer in that order.

Further features of the present invention will become apparent from the following description of exemplary embodiments with reference to the attached drawings.

DESCRIPTION OF THE EMBODIMENTS

The present invention provides a liquid ejection head substrate capable of heating a liquid efficiently and suppressing alteration of the surface of a heat-generating resistor layer during a production process.

First Embodiment

Head Substrate

A head substrate 100, which is a liquid ejection head substrate according to the present embodiment, used for a liquid ejection head configured to eject a liquid, e.g., ink, will be described with reference to FIGS. 1A to 1C and FIG. 7. In this regard, the materials and thicknesses of the embodiments described below are just examples of the present invention.

Figure 7:
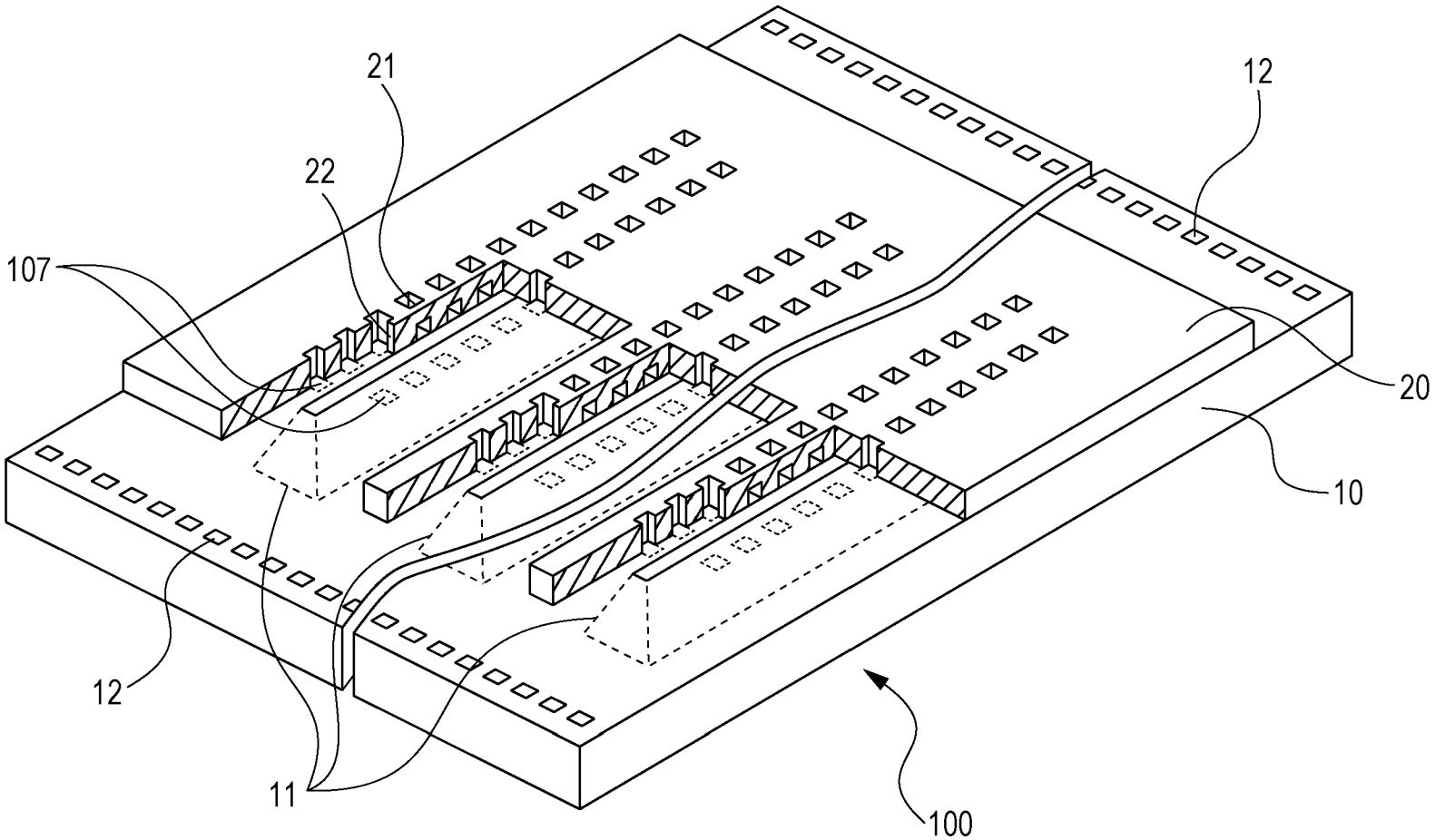
FIG. 7 is a diagram illustrating a head substrate.

FIG. 7 is a perspective view of the head substrate 100. As shown in FIG. 7, the head substrate 100 includes a substrate 10 provided with heat-generating resistors 107 and an ejection port forming member 20 provided with ejection ports 21 configured to eject the liquid and flow passages 22 configured to communicate with ejection ports 21. Also, the substrate 10 includes supply ports 11 configured to supply the liquid to be ejected and terminals 12 configured to send signals for driving the heat-generating resistors 107 and electric power to be supplied to the heat-generating resistors 107 to the substrate 10.

Figure 1A:
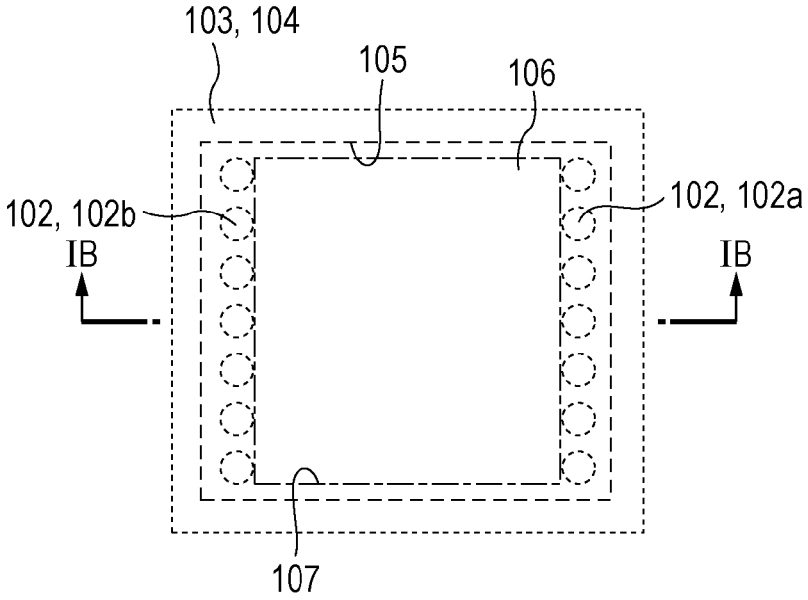
FIGS. 1A to 1C are diagrams showing a heat-generating resistor and its vicinity of a head substrate according to a first embodiment.
Figure 1B:
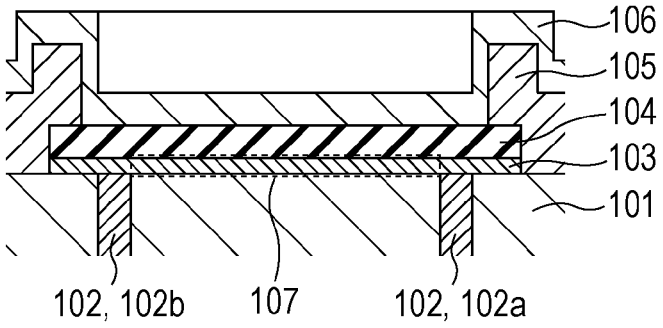

FIG. 1A is a top view showing the heat-generating resistor 107 of the head substrate 100 and its vicinity. FIG. 1B is a sectional view of a section along a line IB-IB shown in FIG. 1A. The ejection port forming member 20 is not shown in FIG. 1.

The stacking configuration of the head substrate 100 will be described. In the head substrate 100, a heat storage layer 101 composed of a silicon substrate (not shown in the drawing), a thermal oxide film, a SiO film, a SiN film, and the like is disposed. In the heat storage layer 101, electrodes 102, which extend from the surface of the heat storage layer 101 toward the back surface and which are composed of a metal material, e.g., W, TiN, or an Al alloy, (hereafter may be referred to as "a pair of electrodes 102*a* and 102*b*") are disposed. The surfaces of the heat storage layer 101 and the electrodes 102 are subjected to a planarization treatment, e.g., chemical mechanical polishing (CMP method) or etch back. Therefore, the surfaces of the heat storage layer 101 and the electrodes 102 are substantially flat faces. A heat-generating resistor layer 103, which is composed of a film of TaSiN, WSiN, or CrSiN, having a thickness of 10 to 50 nm is disposed on these surfaces. An insulating layer 104, which is composed of an insulating material, e.g., SiN, SiO, or SiCN, having a thickness of 50 to 300 nm is further disposed on the surface of the heat-generating resistor layer 103. The heat-generating resistor layer 103 and the insulating layer 104 are disposed so as to have the same pattern by dry etching.

In this configuration, as indicated by alternate long and short dashed lines shown in FIG. 1A, a region inside the pair of electrodes 102*a* and 102*b* in the heat-generating resistor layer 103 serves as a heat-generating resistor 107. A plurality of pairs of electrodes 102*a* and 102*b* are disposed with respect to one heat-generating resistor 107, and the region of the heat-generating resistor 107 is demarcated by the plurality of pairs of electrodes 102*a* and 102*b*. An electric power is supplied from the power supply, although not shown in the drawing, to the pair of electrodes 102*a* and 102*b*, the heat-generating resistor 107 generates heat, bubble generation of the liquid occurs in the flow passages 22 and, thereby, the liquid is ejected.

In addition, an end portion cover layer 105, which is composed of an insulating material, e.g., SiN, SiO, or SiCN, which is configured to cover the end portion of the heat-generating resistor layer 103, and which has a thickness of 50 to 300 nm, is disposed on the surfaces of the heat storage layer 101 and the insulating layer 104. The end portion cover layer 105 is disposed so as to surround the peripheral edge of the end portion of the heat-generating resistor layer 103, when viewed from a direction orthogonal to the surface of the head substrate 100. In FIG. 1A, the position of the end portion of the end portion cover layer 105 on the surface of the insulating layer 104 is indicated by a broken line. The end portion cover layer 105 is not disposed on a portion overlapping the region of the heat-generating resistor 107, when viewed from a direction orthogonal to the surface of the head substrate 100.

Also, a protective layer 106, which is composed of Ta, Ir, Ru, or the like and which protects the heat-generating resistor layer 103 and the insulating layer 104 from an impact due to cavitation associated with bubble generation or debubbling, is further disposed. The protective layer 106 has a thickness of 50 to 300 nm and covers the heat-generating resistor layer 103 and the insulating layer 104. Furthermore, it is not necessary to provide the protective layer 106.

In this regard, the insulating layer 104, the end portion cover layer 105, and the protective layer 106 may be referred to as, a first cover layer, a second cover layer, and a third cover layer, respectively.

Method for Manufacturing Head Substrate

Figure 5A:
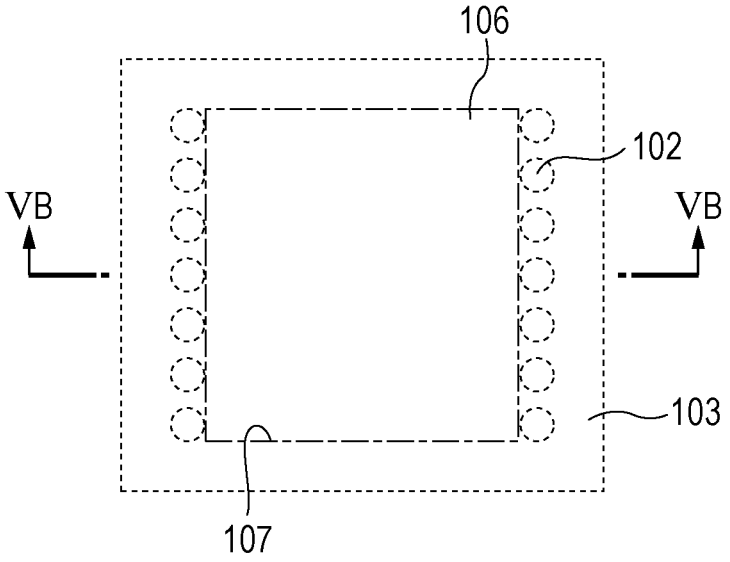
FIGS. 5A and 5B are diagrams showing a heat-generating resistor and its vicinity of a head substrate according to a comparative example.
Figure 5B:
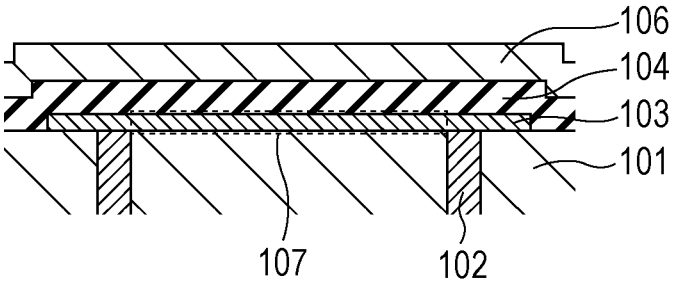

Next, issues in the production process of the head substrate 100 will be described with reference to FIGS. 5A and 5B and FIGS. 6A to 6F. FIG. 5A is a top view showing the heat-generating resistor 107 of the head substrate according to a comparative example and its vicinity. FIG. 5B is a sectional view of a section along a line VB-VB shown in FIG. 5A. FIGS. 6A to 6F are step flow diagrams showing a method for manufacturing the head substrate 100 according to the comparative example.

As shown in FIG. 5B, the head substrate according to the comparative example has a configuration in which through holes disposed in the heat storage layer 101 are filled with W so as to dispose the electrodes 102, and the heat-generating resistor layer 103 is disposed on the surfaces thereof.

Figure 6A:
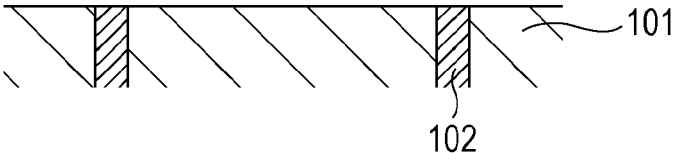
FIGS. 6A to 6F are diagrams showing production steps of the head substrate according to the comparative example.
Figure 6B:
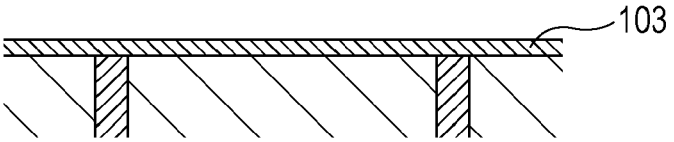
Figure 6C:
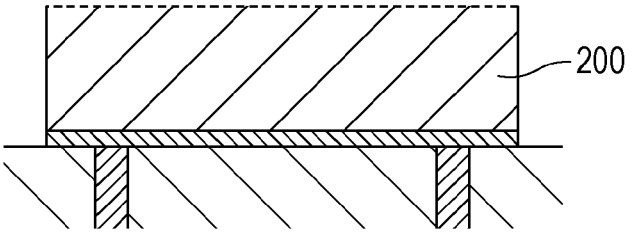

A method for manufacturing the head substrate according to the comparative example will be described. As shown in FIG. 6A, a P—SiO film (silicon oxide formed by a plasma CVD method) formed on the basis of a $SiH_4$ gas is disposed as part of the heat storage layer 101, and through holes are formed in the heat storage layer 101. The through holes are filled with W and the surface is planarized by the CMP method so as to form W plugs serving as the electrodes 102. The heat-generating resistor layer 103 having a thickness of 10 to 50 nm is formed (FIG. 6B). The surface of the heat-generating resistor layer 103 is coated with a photoresist 200, a pattern is formed by photolithography, and dry etching by plasma using a gas, e.g., $Cl_2$ or $CF_4$, is performed (FIG. 6C).

Figure 6D:
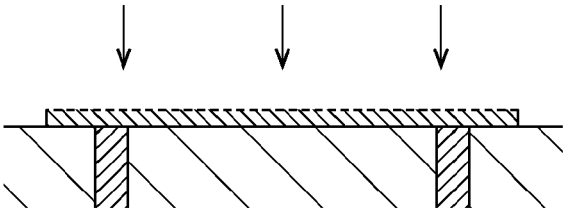
Figure 6E:
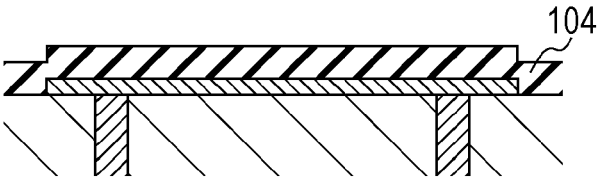
Figure 6F:
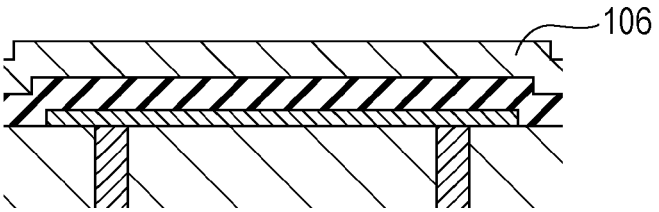

The surface of the photoresist 200 is altered by the dry etching and, therefore, the photoresist 200 is not completely removed by only being dipped into a chemical solution which dissolves the photoresist 200. When bubbles are generated in the liquid, the temperature of the heat-generating resistor layer 103 reaches a high temperature of several hundred degrees. If the photoresist 200 is left on the surface even in small quantities, a breakage may occur at an early stage. Consequently, the photoresist 200 is removed by dry ashing using oxygen plasma or the like capable of removing an altered layer of the photoresist 200. As a result, the surface of the heat-generating resistor layer 103 is exposed to oxygen plasma or the like during dry ashing (FIG. 6D). Thereafter, the insulating layer 104 (FIG. 6E) and the protective layer 106 (FIG. 6F) are formed.

The surface of the thus produced heat-generating resistor layer 103 of the head substrate 100 is oxidized by the oxygen plasma, a portion having a thickness of several nanometers from the surface of the heat-generating resistor layer 103 is altered, and the resistance value of that portion increases. The thickness of the heat-generating resistor is set to be very small in order to increase the resistance value. Therefore, a profound effect is exerted by alteration of even the portion several nanometers from the surface.

A method for manufacturing the head substrate 100 according to the present embodiment will be described. FIGS. 2A to 2F are step flow diagrams showing a method for manufacturing the head substrate 100 according to the present embodiment. In this regard, the thicknesses and materials of the layers described below are just examples of the present embodiment.

Figure 2A:
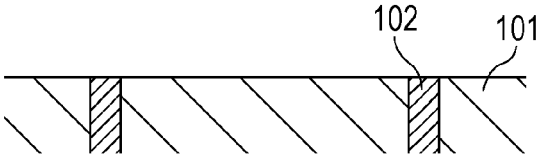
FIGS. 2A to 2F are diagrams showing production steps of the head substrate according to the first embodiment.

The head substrate 100 is produced by stacking a film on the surface of a silicon substrate in which driving elements of semiconductors are incorporated (not shown in the drawing). A P—SiO film formed on the basis of a $SiH_4$ gas is disposed as part of the heat storage layer 101 on the surface of the base substrate, on which the heat-generating resistor layer 103 is to be formed. Through holes are formed in the heat storage layer 101. After TiN serving as a barrier metal is formed in the through holes by a physical vapor deposition method (PVD method), W is embedded by a metal organic chemical vapor deposition method (MO-CVD method). Subsequently, the surfaces of the heat storage layer 101 and W are planarized by the CMP method so as to form W plugs serving as the electrodes 102 (FIG. 2A).

Figure 2B:
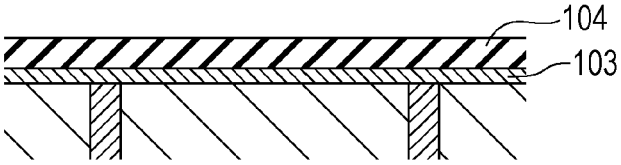

A TaSiN film having a thickness of 15 nm and serving as the heat-generating resistor layer 103 is formed on the planarized surface by the reactive PVD method using TaSi and nitrogen, and a SiN film having a thickness of 100 nm and serving as the insulating layer 104 is formed on the surface thereof by the plasma CVD method (FIG. 2B). The surface of the heat-generating resistor layer 103 is not exposed during this step because patterning is not performed.

Figure 2C:
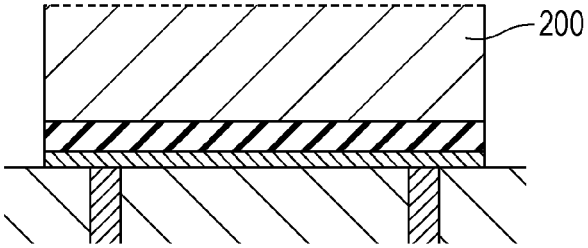

A photoresist 200 as an example of a mask is applied, a pattern is formed by photolithography, this is used as a mask, and dry etching is performed by a reactive ion etching method (RIE method) using $Cl_2$ and $BCl_3$ gases (FIG. 2C). In this manner, the heat-generating resistor layer 103 and the insulating layer 104 are etched in the same step and, therefore, these layers are formed having the same pattern.

Figure 2D:
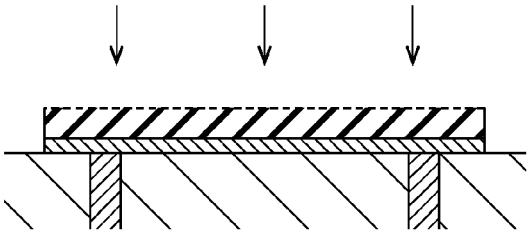

The photoresist 200 is removed by dry asking using oxygen plasma capable of removing an altered surface of the photoresist 200 after dry etching (FIG. 2D).

Figure 2E:
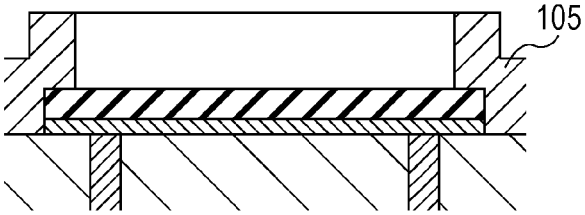

Subsequently, in order to cover the exposed side surface of the heat-generating resistor layer 103, a $SiH_4$ based P—SiO film having a thickness of 200 nm is formed as the end portion cover layer 105 configured to cover the end portion of the heat-generating resistor layer 103 is formed by the plasma CVD method. A pattern having an opening in at least a portion corresponding to the heat-generating resistor 107 is formed by photolithography, the P—SiO film in accordance with the pattern is removed by using BHF so as to form the end portion cover layer 105, and the resist is peeled (FIG. 2E).

Figure 2F:
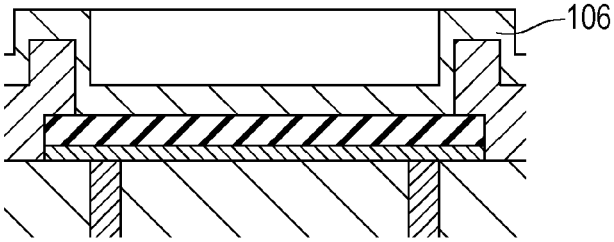

A Ta film having a thickness of 100 nm and serving as the protective layer 106 is formed by the PVD method, a pattern is formed by photolithography, dry etching is performed by the RIE method using a $Cl_2$ gas, and a photoresist is removed by dry ashing (FIG. 2F). Thereafter, processing operations for electrical connection to the outside and the like are performed so as to complete the head substrate 100.

As described above, in the step shown in FIG. 2D of the present embodiment, the surface of the insulating layer 104 is subjected to ashing but the surface of the heat-generating resistor layer 103 is not affected by oxygen plasma because the heat-generating resistor layer 103 is covered by the insulating layer 104. The insulating layer 104 has a thickness larger than the thickness of the heat-generating resistor layer 103 and is less affected by oxidation due to oxygen plasma. Therefore, even when the surface of the insulating layer 104 is subjected to ashing, there is no harm. Consequently, the head substrate 100, in which alteration of the surface of the heat-generating resistor 107 is suppressed, is produced.

The material for the insulating layer 104 can be SiN so that the surface of the insulating layer 104 is not oxidized. In order to protect the surface of the heat-generating resistor layer 103 during ashing regardless of the material for the insulating layer 104, the thickness of the insulating layer 104 is specified as being preferably 50 nm or more. In addition, in order to avoid reduction in the energy efficiency of the heat-generating resistor 107, the thickness of the insulating layer 104 is specified as preferably 300 nm or less. That is, the thickness of the insulating layer 104 is specified as preferably 50 nm or more and 300 nm or less.

In the case where the insulating layer 104 and the protective layer 106 are disposed having small thicknesses in order to enhance the energy efficiency of the heat-generating resistor 107 as well, height differences generated by the heat-generating resistor layer 103 and the insulating layer 104 are covered by the end portion cover layer 105 sufficiently.

The side surface of the end portion of the heat-generating resistor layer 103 is exposed because the patterns of the heat-generating resistor layer 103 and the insulating layer 104 are the same. However, the end portion cover layer 105 is disposed and, thereby, the heat-generating resistor 107 is protected.

Figure 1C:
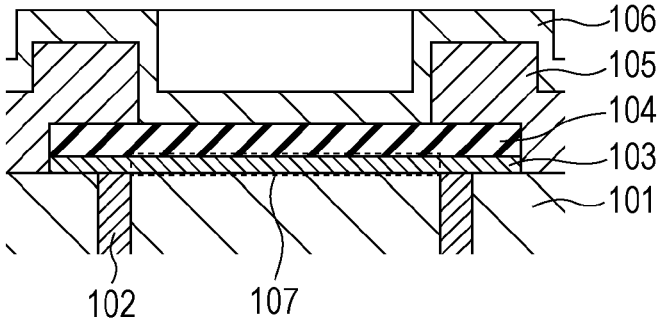

Meanwhile, in contrast to the form shown in FIGS. 1A to 1C, it is assumed that a head substrate has a configuration in which a pair of electrodes 102*a* and 102*b* composed of an electrode layer is disposed on the surface of the heat storage layer 101 and the heat-generating resistor layer 103 and the insulating layer are disposed on the surface of the electrodes 102. In the case where the above-described form is applied to the head substrate having such a configuration, the following issue occurs. That is, in order to protect the surface of the heat-generating resistor layer 103, the heat-generating resistor layer 103 and the insulating layer 104 are etched at the same time and, thereafter, the end portion cover layer 105 is disposed overlapping the peripheral edge of the heat-generating resistor 107, when viewed from a direction orthogonal to the surface of the head substrate. This is because a large height difference is generated by the pair of electrodes 102*a* and 102*b* composed of the electrode layer and, thereby, when the thickness of the insulating layer 104 is small, the height difference portion has to be covered by the end portion cover layer 105. In the case where the end portion cover layer 105 is disposed overlapping the peripheral edge of the heat-generating resistor 107, as described above, the region that contributes to bubble generation of the liquid of the heat-generating resistor 107 may be reduced.

Meanwhile, in the form shown in FIGS. 1A to 1C, in which the electrodes 102 are embedded in the heat storage layer 101, the position and the shape of the heat-generating resistor 107 are demarcated by the pair of electrodes 102*a* and 102*b* and the same film configuration and the flatness are maintained up to the outside of the heat-generating resistor 107. Consequently, it is not necessary to dispose the end portion cover layer 105 so as to overlap the heat-generating resistor 107, when viewed from a direction orthogonal to the surface of the head substrate 100. Therefore, the end portion cover layer 105 is disposed outside the heat-generating resistor 107, and there is no fear of reduction of the region that contributes to bubble generation of the liquid of the heat-generating resistor 107.

The end portion cover layer 105 can be a film of an insulating material in order to ensure insulation between the heat-generating resistor layer 103 and the protective layer 106. However, in the case where the protective layer 106 is composed of a nonconductive material, in the case where the insulation between the heat-generating resistor layer 103 and the protective layer 106 is ensured and, in addition, the end portion cover layer 105 is not corroded because of the potential of the heat-generating resistor 107, and the like, the end portion cover layer 105 may be a film composed of a conductive material.

If the end portion cover layer 105 is a film composed of an insulating material, as shown in FIG. 1C, the end portion cover layer 105 may be disposed such that part of the end portion cover layer 105 overlaps the electrodes 102 so as to cover the electrodes 102, when viewed from a direction orthogonal to the surface of the head substrate 100. Such a form is suitable for the case where the portions of electrodes 102 are dented from the surface of the heat storage layer 101 so as to generate height differences even when the surfaces of the heat storage layer 101 and the electrodes 102 are subjected to the planarization treatment. That is, the height difference portions are covered by the end portion cover layer 105 serving as a thick insulating film by employing the form shown in FIG. 1C so as to more reliably ensure the insulation between the electrodes 102 and the protective layer 106.

Second Embodiment

The configuration and the manufacturing method of the head substrate 100 according to the present embodiment will be described with reference to FIGS. 3A and 3B and FIGS. 4A to 4F. In this regard, the thicknesses, materials, and the like of the layers described below are no more than examples of the present embodiment. Explanations of the same parts as the parts in the above-described embodiment will not be provided.

Figure 3A:
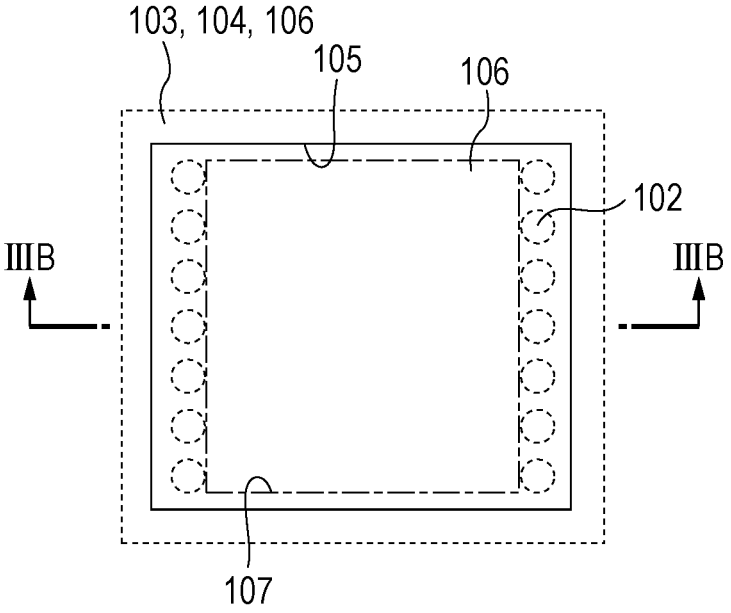
FIGS. 3A and 3B are diagrams showing a heat-generating resistor and its vicinity of a head substrate according to a second embodiment.
Figure 3B:
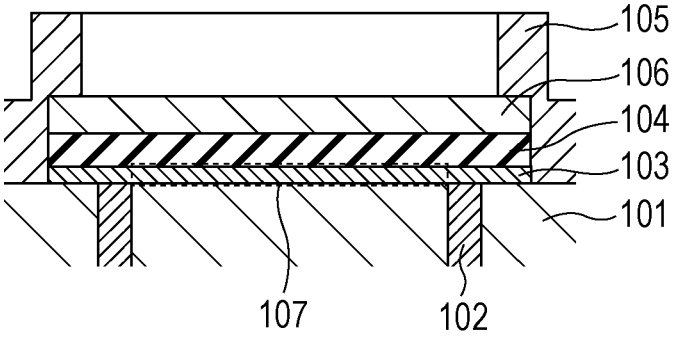

FIG. 3A is a top view showing the heat-generating resistor 107 and its vicinity of the head substrate 100. FIG. 3B is a sectional view of a section along a line IIIB-IIIB shown in FIG. 3A. In the present embodiment, as shown in FIG. 3B, the end portion cover layer 105 is disposed on the surface of the protective layer 106. The end portion cover layer 105 is disposed so as to surround the peripheral edge of the end portion of the heat-generating resistor layer 103, when viewed from a direction orthogonal to the surface of the head substrate 100. In FIG. 3A, the position of the end portion cover layer 105 on the surface of the protective layer 106 is shown.

Figure 4A:
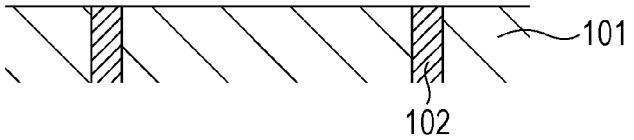
FIGS. 4A to 4F are diagrams showing production steps of the head substrate according to the second embodiment.

FIGS. 4A to 4F are step flow diagrams showing a method for manufacturing the head substrate 100 according to the present embodiment. The process up to the step shown in FIG. 4A is the same as the step shown in FIG. 2A in the first embodiment.

Figure 4B:
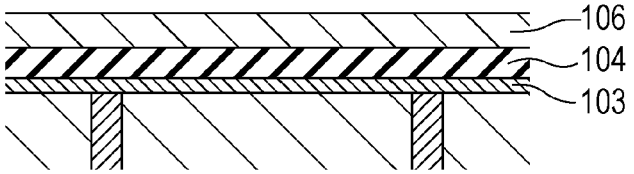

A TaSiN film having a thickness of 15 nm and serving as the heat-generating resistor layer 103 is formed on the planarized surfaces of the heat storage layer 101 and the electrodes 102 by the reactive PVD method using TaSi and nitrogen, and a SiN film having a thickness of 100 nm and serving as the insulating layer 104 is formed on the surface thereof by the plasma CVD method. A Ta film having a thickness of 100 nm and serving as the protective layer 106 is further formed by the PVD method (FIG. 4B). The surfaces of the heat-generating resistor layer 103 and the insulating layer 104 are not exposed during this step because patterning is not performed. In this step, a film of Ir, Ru, or the like may be formed as the protective layer 106 as in the above-described embodiment.

Figure 4C:
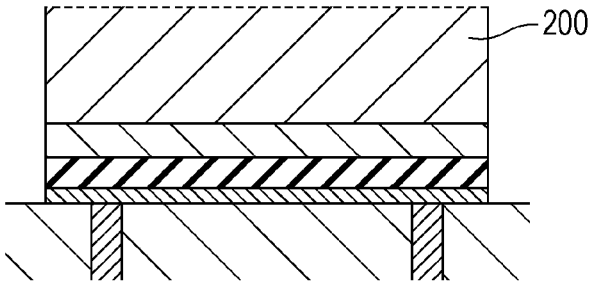

A photosensitive photoresist 200 is applied, a pattern is formed by photolithography, and dry etching is performed by the RIE method using $Cl_2$ and $BCl_3$ gases so as to form the heat-generating resistor 107. In this manner, the heat-generating resistor layer 103, the insulating layer 104, and the protective layer 106 are etched in the same step and, therefore, these layers are formed having the same pattern (FIG. 4C).

Figure 4D:
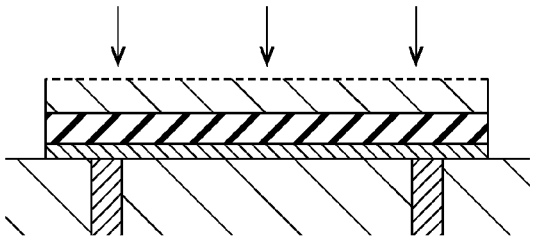

The photoresist 200 is removed by dry asking using oxygen plasma capable of removing an altered surface of the photoresist 200 after dry etching (FIG. 4D).

Figure 4E:
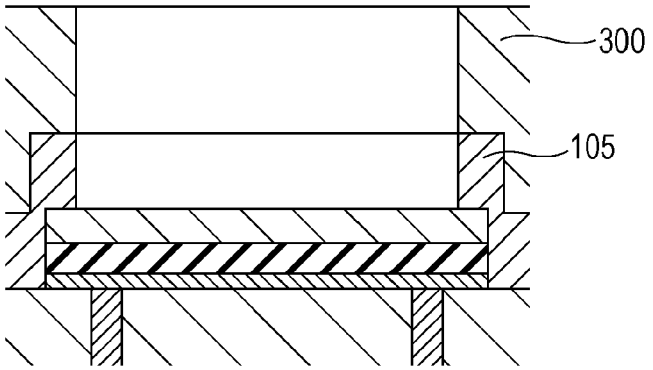

Subsequently, in order to cover the exposed side surface of the heat-generating resistor layer 103, a P—SiCN film serving as the end portion cover layer 105 configured to cover the end portion of the heat-generating resistor layer 103 is formed by the plasma CVD method using a $SiH_4$ gas, a $CH_4$ gas, or the like. A photosensitive photoresist 300 is applied, and a pattern having an opening in at least a portion corresponding to the heat-generating resistor 107 is formed by photolithography. Thereafter, the P—SiCN film is subjected to dry etching in accordance with the pattern by the RIE method using a $CH_4$ gas (FIG. 4E).

Figure 4F:
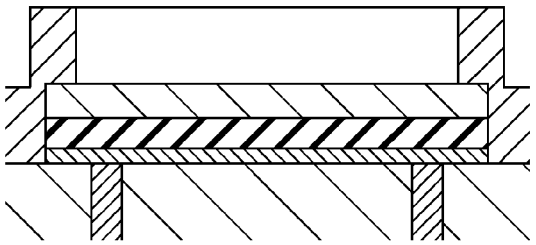

The photoresist 300 is removed by dry ashing using oxygen plasma (FIG. 4F). Then, processing for electrical connection to the outside and the like are performed so as to complete the head substrate 100.

In the step shown in FIG. 4D of the present embodiment, the exposed surface of the protective layer 106 is subjected to ashing but the surface of the heat-generating resistor layer 103 is not affected by oxygen plasma because the heat-generating resistor layer 103 is covered by the insulating layer 104 and the protective layer 106. The protective layer 106 has a thickness larger than the thickness of the heat-generating resistor layer 103 and is less affected by oxidation due to oxygen plasma. Therefore, even when the surface of the protective layer 106 is subjected to ashing, there is no harm. Consequently, the head substrate 100, in which alteration of the surface of the heat-generating resistor 107 is suppressed, is produced.

For example, in the case where a SiCN film is used as the insulating layer 104, the surface of the insulating layer 104 may be altered because of oxidation by oxygen plasma during dry asking. According to the present embodiment, the surface of the insulating layer 104 is covered by the protective layer 106 composed of Ta or Ir. Therefore, alteration of the surface of the insulating layer 104 is suppressed.

In the step shown in FIG. 4E of the present embodiment, the protective layer 106 may be used as an etching stop layer when the end portion cover layer 105 is subjected to dry etching. Consequently, in the case where the end portion cover layer 105 is composed of a SiCN film insoluble into a liquid, even the SiCN film, which is not easily etched by wet etching, is subjected to dry etching with a high selection ratio, and the reliability of the head substrate is enhanced.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-146934, filed Jul. 24, 2015, which is hereby incorporated by reference herein in its entirety.

What is claimed is:

1. A method for manufacturing a liquid ejection head substrate comprising the steps of:

preparing a substrate including a heat storage layer, a pair of electrodes extending from a surface of the heat storage layer toward a back surface of the heat storage layer, a heat-generating resistor layer in contact with the pair of electrodes and the surface of the heat storage layer, and a first cover layer configured to cover a surface of the heat-generating resistor layer;

etching the heat-generating resistor layer and the first cover layer by using a mask in such a manner that the heat-generating resistor layer on the pair of electrodes and on the surface of the heat storage layer between the pair of electrodes remains;

removing the mask in a state where the surface of the heat-generating resistor layer on the pair of electrodes and on the surface of the heat storage layer between the pair of electrodes is covered with the first cover layer; and forming a second cover layer configured to cover an end portion of the heat-generating resistor layer after removing the mask, wherein the first cover layer is composed of an insulating material and the second cover layer is composed of an insulating material.

2. The method for manufacturing a liquid ejection head substrate, according to claim 1, wherein the second cover layer is formed at a position not overlapping a heat-generating resistor region, which is demarcated by the pair of electrodes, in the heat-generating resistor layer, when viewed from a direction orthogonal to the surface of the heat storage layer.

3. The method for manufacturing a liquid ejection head substrate, according to claim 1, wherein the second cover layer is formed such that part of the second cover layer overlaps the pair of electrodes, when viewed from a direction orthogonal to the surface of the heat storage layer.

4. The method for manufacturing a liquid ejection head substrate, according to claim 1, wherein the second cover layer is formed such that the second cover layer does not overlap the pair of electrodes, when viewed from a direction orthogonal to the surface of the heat storage layer.

5. The method for manufacturing a liquid ejection head substrate, according to claim 1, wherein the first cover layer is composed of SiN.

6. The method for manufacturing a liquid ejection head substrate, according to claim 1, wherein a thickness of the first cover layer is 50 nm or more and 300 nm or less.

7. The method for manufacturing a liquid ejection head substrate, according to claim 1, wherein a thickness of the second cover layer is 50 nm or more and 300 nm or less.

8. The method for manufacturing a liquid ejection head substrate, according to claim 1, wherein in the preparing of the substrate, the substrate further includes preparing a third cover layer configured to cover the first cover layer, in the etching, the heat-generating resistor layer, the first cover layer, and the third cover layer are etched, the forming of the second cover layer includes the steps of forming a film configured to cover the third cover layer and etching the film configured to cover the third cover layer in order to form the second cover layer, and in the etching the film configured to cover the third cover layer, the etching is stopped at the third cover layer.

9. The method for manufacturing a liquid ejection head substrate, according to claim 1, wherein the mask is removed by dry ashing using oxygen plasma.

10. The method for manufacturing a liquid ejection head substrate, according to claim 1, wherein the pair of electrodes and the surface of the heat storage layer are subjected to a planarization treatment.

11. The method for manufacturing a liquid ejection head substrate, according to claim 1, further comprising:

forming a third cover layer covering the first cover layer.

12. The method for manufacturing a liquid ejection head substrate, according to claim 11, wherein in the forming of the third cover layer, the third cover layer is formed so as to cover at least part of the second cover layer.

13. The method for manufacturing a liquid ejection head substrate, according to claim 1, wherein in the preparing of the substrate, the substrate includes preparing a plurality of the pairs of electrodes.

* * * * *